US012480386B2

(12) United States Patent
Krueger et al.

(10) Patent No.: US 12,480,386 B2
(45) Date of Patent: Nov. 25, 2025

(54) LINER HANGER SYSTEM AND METHOD

(71) Applicant: Baker Hughes Oilfield Operations LLC, Houston, TX (US)

(72) Inventors: Matthew Krueger, Cypress, TX (US); Leif Nordenstam, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 97 days.

(21) Appl. No.: 18/323,986

(22) Filed: May 25, 2023

(65) Prior Publication Data

US 2024/0392659 A1 Nov. 28, 2024

(51) Int. Cl.

| | |
|---|---|
| ***E21B 43/10*** | (2006.01) |
| ***E21B 23/04*** | (2006.01) |
| ***E21B 23/06*** | (2006.01) |
| ***E21B 47/06*** | (2012.01) |
| ***E21B 47/18*** | (2012.01) |

(52) U.S. Cl.

CPC ..... *E21B 43/10* (2013.01); *E21B 23/0413* (2020.05); *E21B 23/06* (2013.01); *E21B 47/06* (2013.01); *E21B 47/18* (2013.01); *E21B 2200/08* (2020.05)

(58) Field of Classification Search

CPC ..... E21B 43/10; E21B 23/0413; E21B 23/06; E21B 23/065; E21B 23/01; E21B 23/00

See application file for complete search history.

(56) References Cited

U.S. PATENT DOCUMENTS

| | | | | |
|---|---|---|---|---|
| 6,245,841 | B1 | 6/2001 | Yeager et al. | |
| 9,074,437 | B2 | 7/2015 | Stingerie et al. | |
| 11,299,966 | B1 | 4/2022 | Krueger | |
| 11,326,411 | B2 * | 5/2022 | Duggan | E21B 36/00 |
| 2008/0093090 | A1 | 4/2008 | Jaques et al. | |
| 2013/0043047 | A1 * | 2/2013 | Fay | E21B 23/02 166/85.5 |
| 2016/0084018 | A1 * | 3/2016 | Allen | E21B 17/07 166/381 |
| 2016/0130896 | A1 | 5/2016 | Halfmann | |
| 2017/0362910 | A1 | 12/2017 | Stephens et al. | |

FOREIGN PATENT DOCUMENTS

| | | | |
|---|---|---|---|
| EP | 0396383 | A2 | 11/1990 |
| EP | 2291576 | B1 | 2/2019 |
| WO | 2022232765 | A1 | 11/2022 |

OTHER PUBLICATIONS

Notification of Transmittal of the International Search Report and The Written Opinion; PCT/US2024/029351; Korean Intellectual Property Office; Mailed Aug. 30, 3034; 14 pages.

* cited by examiner

*Primary Examiner* — Blake Michener

(74) *Attorney, Agent, or Firm* — Baker Hughes Patent Organization

(57) ABSTRACT

A tool with anti-preset feature including a tool body including a setter, an anti-preset member anchoring the setter to the tool, and a releaser that loses structural integrity through heat or chemical degradation upon receipt of a signal configured to defeat the anti-preset member. A method for setting a liner hanger, including running the liner hanger setting system to a target location in a borehole, sending a signal to the releaser, defeating the releaser, and facilitating relative movement between the liner hanger body and the setter. A borehole system, including a borehole in a subsurface formation, a string in the borehole, and a tool disposed within or as a part of the string.

15 Claims, 6 Drawing Sheets

LINER HANGER SYSTEM AND METHOD

BACKGROUND

In the resource recovery and fluid sequestration industries, liners are often used. Liner hangers are put in place to support such liners. Liner hangers are run in the hole and generally hydraulically actuated. When they work properly they are reliable but more often than would be desired, liner hangers may be preset due to friction in the borehole. This results in setting of the linger hanger in the wrong place and potential damage to the borehole in addition to causing delay. Accordingly, the art will enthusiastically receive alternative systems that avoid the drawbacks of traditional systems.

SUMMARY

An embodiment of a tool with anti-preset feature including a tool body including a setter, an anti-preset member anchoring the setter to the tool, and a releaser that loses structural integrity through heat or chemical degradation upon receipt of a signal configured to defeat the anti-preset member.

An embodiment of a liner hanger setting system, including a running tool, including an actuator package, a first pressure sensor uphole of a plug location connected to the actuation package, a second pressure sensor downhole of the plug location connected to the actuator package, the package programmed to perceive a differential pressure between the first and second pressure sensors, a signal propagator operably connected to the actuator package, a liner hanger body including a slip and a slip setter initially supported by the running tool, an anti-present member anchoring the slip setter to the liner hanger, and a releaser that loses structural integrity through heat or chemical degradation upon receipt of a signal configured to defeat the anti-preset member, the releaser in operable communication with the signal propagator.

An embodiment of a method for setting a liner hanger, including running the liner hanger setting system to a target location in a borehole, sending a signal to the releaser, defeating the releaser, and facilitating relative movement between the liner hanger body and the setter.

An embodiment of a borehole system, including a borehole in a subsurface formation, a string in the borehole, and a tool disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
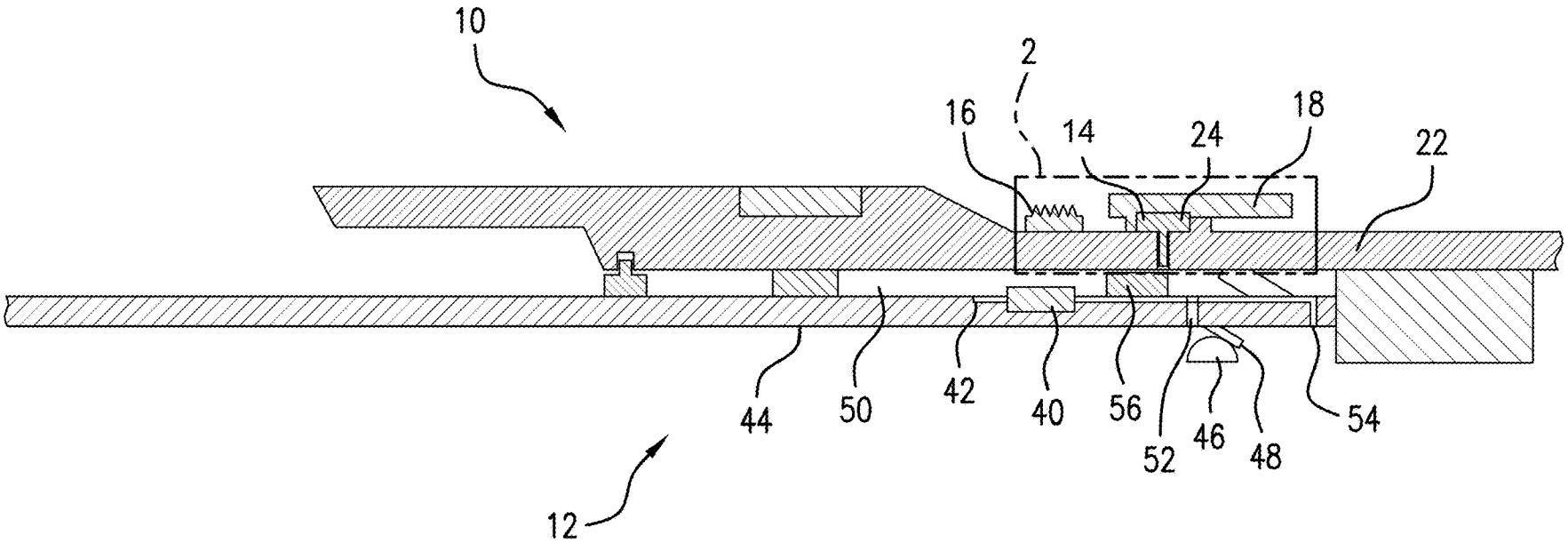
FIG. 1 is a schematic cross section of a liner hanger with anti-preset feature.

Referring to FIG. 1, a tool 10 is illustrated. In one embodiment the tool is a liner hanger (as shown) but other tools are contemplated including, open hole packers, coil tubing connectors, liner packers, cased hole packers, bridge plugs, service packers, etc. The particular illustration of FIG. 1 also includes a running tool 12 within the hanger 10. The hanger 10 includes an anti-preset feature 14. The hanger 10 includes a slip 16 that is actuated by a slip setter 18. Slip setter 18 could be a setting cylinder on a hydraulic liner hanger, for instance. A similar embodiment could be used on a liner top packer which sets mechanically from axial travel of the liner top polished bore receptacle. One skilled in the art could adapt the invention to a variety of other applications and designs.

Slip setter 18 is actuable in traditional ways, generally by hydraulic actuation. This is well known and hence omitted from this application. The hanger 10 anti-preset feature 14 anchors the slip setter 18 a hanger body 22 of the hanger 10 until release is desired. The feature 14 comprises a releaser 24. The releaser 24 may be all of the feature 14 or may be a portion of the feature 14. If the releaser is only a portion of the feature 14, in some embodiments, the portion would initially bond one part of the feature 14 to another part of the feature 14, those parts, respectively, being in some way affixed to the slip setter 18 and the hanger body 22 such that when the portion that is the releaser 24 is degraded, the one part of the feature 14 will no longer be structurally connected to the other part of the feature 14 even though the two parts themselves still possess their original structural integrity. For example, a radially outward part of the feature 14 may be affixed to the slip setter 18 and a radially inward part of the feature 14 may be affixed to the housing 22 with the releaser 24 in between holding the first part and the second part together. Then, when that releaser 24 is melted or otherwise degraded, the two parts of the feature 14 as described (and with them the setter 18 and the housing 22) may move relative to one another. In the event the feature is entirely made up of the releaser 24, then upon melting or other degradation of the releaser 24 the setter 18 and housing 22 may move relative to one another. In each case, the releaser 24 may comprise a temperature responsive material that loses structural integrity when heated (heat degradation or melting contemplated) or may comprise an energetic material that upon receipt of the signal initiates a self-sustaining and self-propagating reaction that chemically degrades the material. This material may also be used for its exothermic property to melt another releaser 24 material. In one embodiment, the material of the releaser 24 is a degrade on demand material such as energetic disintegrable material an embodiment of which is discussed later herein, that responds to a voltage signal to ignite and degrade the structural integrity thereof.

Figure 2:
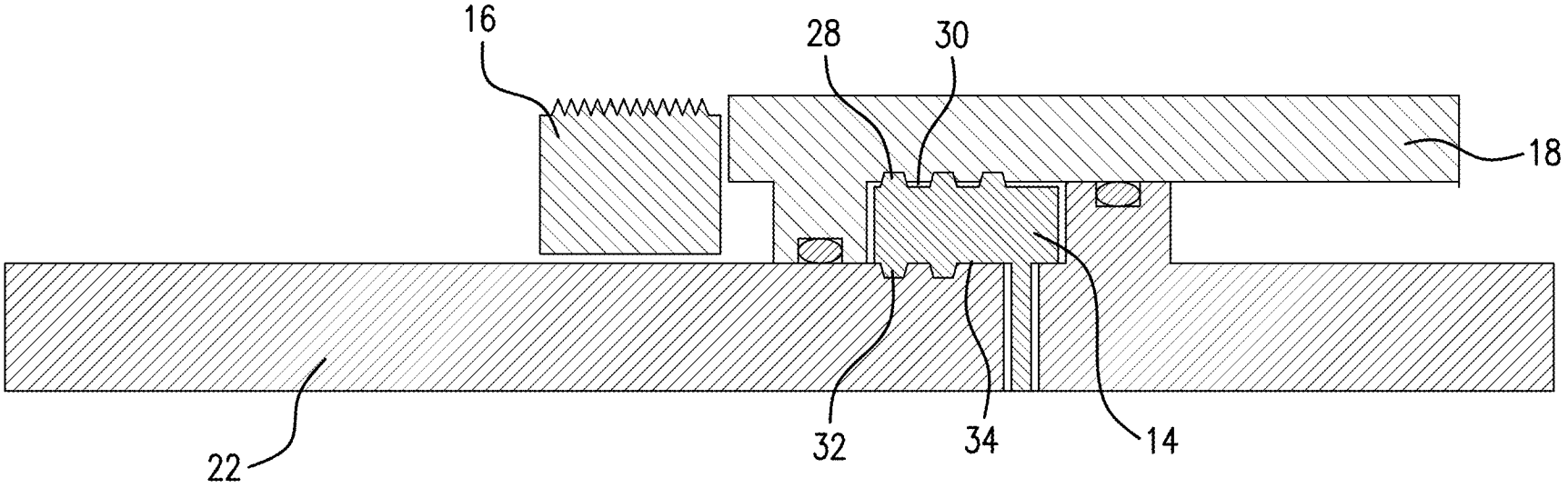
FIG. 2 is an enlarged view of FIG. 1 taken at circumscription line 2-2.

In an embodiment, referring to FIG. 2, the feature 14 is provided with a geometric mechanical engagement 28 on an outside diameter surface 30 thereof, that engagement being wickers, threads, castellations, etc. The feature 14 may also have a geometric mechanical engagement 32 at an inside diameter surface 34, that engagement being wickers, threads, castellations, etc. The features or other anchoring configuration is configured to resist loads associated with running the hanger 10 in the borehole while preventing presetting of the hanger 10.

The anti-preset feature 14 is responsive to a signal such as a voltage or to ignition by preignition of another volume of material (which may be the same material) responsive to the initiation signal. It is to be understood that components related to actuation could be installed on the liner hanger 10 itself but then they would be left downhole and increase the cost of the liner hanger. Accordingly, one embodiment places these components on the running tool 12 so that they are retrievable to surface after setting of the liner hanger 10. It will be understood that these components could be disposed as noted directly on the hanger and that such an embodiment is contemplated herein.

Referring back to FIG. 1, the actuation components referred to above generically are described and numbered. Running tool 12 includes an actuation package 40 that is connected to a first pressure sensor 42 positioned so that it may measure pressure at an inside diameter 44 of the tool 12 upstream of a plug 46 landed at a seat 48 of the tool 12. This pressure may alternatively be sensed in the annulus 50 between the hanger body 22 and the tool 12 if a port 52 is provided. The package 40 is further connected to a second pressure sensor 54 located to sense pressure downstream of the plug 46. When pressure difference reaches a selected threshold the actuator package 40 generates a signal (using e.g. a battery). In one embodiment a low voltage electric signal is employed but others are contemplated. The signal is sent either directly to the releaser 24 where an electrical connection such as wiring is plausible or indirectly through a signal propagator 56. Signal propagator 56 is in one embodiment an additional volume of Degrade on Demand material. In this embodiment, the propagator is positioned very near the releaser 24, "very near" meaning that the degradation of the propagator 56 will cause the degradation of the releaser 24. In an embodiment this is characterized by the propagator burning and the heat of burning is sufficient to cause ignition of the releaser.

The energetic disintegrable material includes a polymer matrix; an energetic material configured to generate heat upon activation to facilitate a chemical decomposition of the disintegrable material and at least one of a reinforcing fiber or a filler. The energetic disintegrable material, when initiated undergoes a self-sustained and self-propagated reaction that is not affected by downhole fluid or hydrostatic pressure. The self-sustained and self-propagated reaction generates heat and chemically decomposes a polymer in the polymer matrix. The decomposed product generated from the polymer decomposition includes small molecules that may turn into a supercritical state when the temperature and pressure applied to the small molecules exceeds the supercritical temperature and the supercritical pressure of the small molecules. Advantageously, the generation of the small molecules in a supercritical state does not lead to dramatic pressure change, but nonetheless may facilitate the disintegration of the energetic disintegrable material in a safe and controllable manner.

The polymer matrix comprises a polymer, which provides the general material properties such as strength and ductility for tool functions. The polymer is non-corrodible in a downhole fluid such as water, a brine, or an acid. The polymer in the polymer matrix has an oxygen content of about 2 to about 30 wt %, preferably about 3 to about 25 wt %, more preferably about 5 to about 20 wt %, based on a total weight of the polymer. Without wishing to be bound by theory, it is believed that when the polymer has an oxygen content within these ranges, the polymer undergoes appropriate activation and decomposition with the energetic materials leading to the decomposed product including a small molecule that may turn into a supercritical state to facilitate the disintegration of the energetic disintegrable material in a safe and controlled manner. The polymer may include at least one of an epoxy, a phenolic resin, an epoxy phenolic resin, a vinyl ester, a polybismaleimide, a cyanate ester, or a polyester.

As used herein, an epoxy refers to a cured product of an epoxide that contains one or more epoxide groups. The preferred epoxy suitable for use in the energetic disintegrable material may be formed from at least one of an aliphatic epoxide such as butanediol diglycidyl ether, a bisphenol epoxide such as bisphenol-A diglycidyl ether (CAS #1675-54-3) and/or bisphenol-F diglycidyl ether, or a novolac epoxide such as phenol-formaldehyde polymer glycidyl ether (CAS #28064-14-4). The curing agent includes an active group that may react with an epoxy group. Examples of such an active group include amino groups and acid anhydride groups. In an aspect the curing agent is at least one of an aliphatic amine or an aromatic amine.

The epoxy may contain an aromatic structure and an aliphatic structure in the backbone of the polymers, where the aliphatic structure contains an ether (C—O) bond. The aromatic structure may be difficult to decompose while the aliphatic structure may be easier to decompose. In an aspect, the epoxy contains a polymerized diglycidylether of a bisphenol wherein the number of the repeating units range from 0 to 18, preferably 0 to less than 2.5. For example the epoxy may include a bisphenol A diglycidyl ether epoxy having the formula

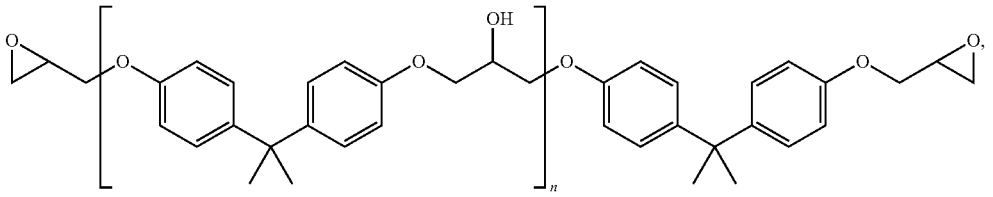

wherein n is the number of repeating units, and may be 0 to 18, preferably 0 to less than 2.5. Without wishing to be bound by theory, it is believed that when the repeating units are within these ranges, the epoxy may readily decompose when exposed to the heat generated by the self-propagation reaction of the energetic material described herein.

Phenolic resin, also known as phenolic formaldehyde resin, is a synthetic resin produced from the polymerization of a phenol ($C_6H_5OH$), an alkyl-substituted phenol, a halogen-substituted phenol, or a combination thereof, and a formaldehyde compound such as formaldehyde ($CH_2C{=}O$). The polymer may include repeating units such as —[($C_6H_3OH$)—$CH_2$]—.

Epoxy phenolic resin is phenolic resin modified at the phenolic hydroxyl group to include an epoxide functional group such as —$CH_2$—($C_2H_3O$), where —($C_2H_3O$) is a three-membered epoxide ring. The added functionality of the phenolic resin increases the ability for the resin to crosslink, creating a stronger polymer with high resistivities.

Vinyl ester (vinyl acetate) is a resin produced by the esterification of an epoxy resin with acrylic or methacrylic acids.

The polybismaleimide may be synthesized by condensation of phthalic anhydride with an aromatic diamine, which yields bismaleimide such as 4,4'-bismaleimidodiphenylmethane, followed by subsequent Michael addition of more diamine to the double bond at the ends of the bismaleimide. The monomer bismaleimide may also be copolymerized with vinyl and allyl compounds, allyl phenols, isocyanates, aromatic amines, or a combination thereof. Bismaleimide is often copolymerized with 2,2'-diallyl bisphenol A.

Cyanate esters are compounds generally based on a phenol or a novolac derivative, in which the hydrogen atom of the phenolic OH group is substituted by a cyanide group (—OCN). Suitable cyanate esters include those described in U.S. Pat. No. 6,245,841 and EP 0396383. Cyanate esters may be cured and postcured by heating, either alone, or in the presence of a catalyst. Curing normally occurs via cyclotrimerization (an addition process) of three CN groups to form three-dimensional networks comprising triazine rings.

The polyester may be formed by the reaction of a dibasic organic acid and a dihydric alcohol. Orthophthalic polyesters are made by phthalic anhydride with either maleic anhydride or fumaric acid. Isophthalic polyesters are made from isophthalic acid or terephthalic acid. Isophthalic polyesters are preferred due to the improved corrosion resistance and mechanical properties.

Use of energetic materials disclosed herein is advantageous as these energetic materials are stable at wellbore temperatures but may undergo a self-sustained and self-propagated reaction that is not affected by downhole fluid or hydrostatic pressure. In addition, the energetic material may react without the need for environmental oxygen supply. The self-sustained and self-propagated reaction generates heat, which facilitates the chemical decomposition of the polymer in the polymer matrix.

The energetic material includes, for example, a reducing agent such as a metal powder and an oxidizing agent such as a metal oxide or a polymer that produces an exothermic oxidation-reduction reaction known as a thermite reaction. Choices for a reducing agent include at least one of aluminum, magnesium, calcium, titanium, zinc, silicon, or boron, for example, while choices for an oxidizing agent include at least one of boron oxide, silicon oxide, chromium oxide, manganese oxide, iron oxide, copper oxide, nickel oxide, silver oxide, lead oxide, or polytetrafluoroethylene (PTFE), for example.

The amount and the composition of the energetic material are selected that the energetic material does not result in an explosion, rather the heat generated by the energetic material is used to facilitate the chemical decomposition of the polymer in the polymer matrix, not to physically destroy the matrix such as by explosion. A weight ratio of the polymer matrix to the energetic material is about 1:7 to about 1:1, preferably about 1:6 to about 1:2, more preferably about 1:5 to about 1:3.

The reinforcing fiber is used to increase the tensile strength and the compressive strength of the downhole article. The reinforcing fiber comprises at least one of carbon fiber, glass fiber, polyethylene fiber, or aramid fiber. The form of the reinforcing fiber is not particularly limited, and may include fiber filaments; fiber rovings; fiber yarns; fiber tows; fiber tapes; fiber ribbons; fiber meshes; fiber tubes; fiber films; fiber braids; woven fibers; non-woven fibers; or fiber mats. The reinforcing fiber may include at least one of continuous fibers or short fibers. Continuous fibers may be disposed within the energetic disintegrable material along a reinforcing direction, providing a continuous path for load bearing, while short fibers may be blended into the polymer matrix in a random or semi-random orientation. Short fibers may include staple fibers, chopped fibers, or whiskers. Staple fibers typically have a lengths of about 10 to about 400 mm. Chopped fibers may have a lengths of about 3 to about 50 mm while whiskers are a few millimeters length. Combinations of the fibers in different forms and different compositions may be used.

Depending on the desired mechanical strength, a ratio of a total weight of the polymer matrix and the energetic material relative to a weight of the reinforcing fiber may be about 40:1 to about 5:1, preferably about 30:1 to about 10:1.

The energetic disintegrable material may comprise a filler. Examples of the filler include at least one of carbon black, mica, clay, a ceramic material, a metal, or a metal alloy. Ceramic materials include SiC, $Si_3N_4$, $SiO_2$, BN, and the like. Examples of the metal or metal alloy may include at least one of lightweight aluminum alloys, magnesium alloys, or titanium alloys. The metal or metal alloy may also be the excess metal/metal alloy in the energetic material that does not participate in an oxidation-reduction reaction. The filler may be present in an amount of about 0.5 to about 10 wt. %, or about 1 to about 8% based on the total weight of the energetic disintegrable material.

The reinforcing fiber, the filler, and the energetic material may be randomly distributed in the polymer matrix. Alternatively, the energetic disintegrable materials may have a layered structure and comprise a first layer and a second layer disposed on the first layer, wherein the first layer contains the reinforcing fiber describe herein and the second layer comprises the polymer and the energetic material described herein.

It is to be appreciated that the energetic disintegrable material may have more than one first layer and more than one second layer. For example, the energetic disintegrable material may include alternating first and second layers. The thicknesses of the first and second layers are not particularly limited. In an aspect, the thickness of the first layer relative to the thickness of the second layer is about 10:1 to about 1:10 or about 5:1 to about 1:5, or about 2:1 to about 1:2.

Figure 3A:
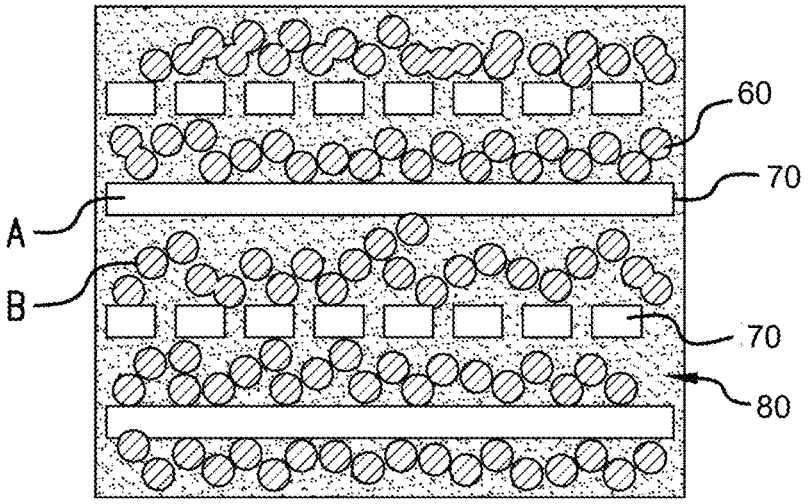
FIG. 3A is a schematic diagram of an embodiment of a disintegrable downhole article comprising a polymer matrix, an energetic material, and an reinforcing fiber.
Figure 3B:
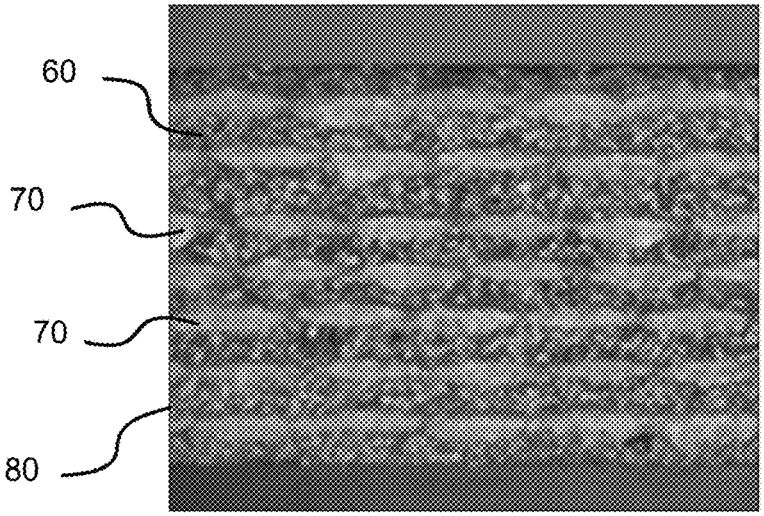
FIG. 3B is a microstructure of a cross section of the disintegrable downhole article of FIG. 3A.
Figure 4:
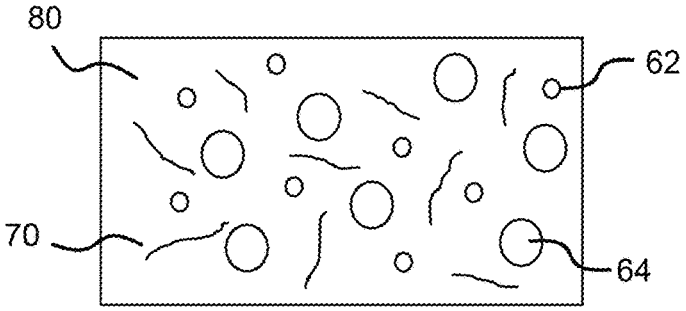
FIG. 4 is a schematic diagram of another embodiment of a disintegrable downhole article comprising a polymer matrix, an energetic material, and an reinforcing fiber.

The microstructures of the energetic disintegrable materials are illustrated in FIGS. 3A, 3B, and 4. Referring to FIGS. 3A and 3B, the energetic disintegrable material includes alternating layers A and B, where layer A contains a reinforcing fiber 70 and layer B contains an energetic material 60 and a polymer matrix 80. Referring to FIG. 4, the energetic disintegrable material includes an energetic material 62, 64 and a reinforcing fiber 70 randomly disposed in the polymer matrix 80.

The polymer, the energetic material, and at least one of the reinforcing fiber or filler may form a composite. When the composite includes a continuous fiber (also referred to as continuous fiber composite), the composite may have a greater tensile strength than compressive strength. For example, the continuous fiber composite may have a tensile strength of about 40 to about 50 kilopound per square inch (ksi), determined in accordance with ASTM D3039. The continuous fiber composite may have a compressive strength of about 14 to about 33 ksi, determined in accordance with ASTM D6641. A ductility of the continuous fiber composite may be about 1 to about 4%.

When the composite comprises a short fiber (also referred to as "short fiber composite"), the composite may have a greater compressive strength than tensile strength. For example, the short fiber composite may have a tensile strength of about 10 to about 15 ksi, determined in accordance with ASTM D3039, and a compressive strength of about 25 to about 40 ksi, determined in accordance with ASTM D6641. A ductility of the short fiber composite may be about 5 to about 10%.

The energetic disintegrable material comprises the composite and may be manufactured from the polymer, the energetic material, and at least one of the reinforcing fiber or the filler. In an aspect, a mold is alternately loaded with a reinforcing fiber, for example a reinforcing fiber layer or reinforcing fiber mesh and a combination comprising an energetic material and a polymer to provide a reinforced composition. The reinforced composition is then molded to form an energetic disintegrable material. Alternatively, at least one of the reinforced fiber or a filler, the energetic material and the polymer may be mixed and then molded to form an energetic disintegrable material. The energetic disintegrable material may be further machined or shaped to form an energetic disintegrable material having the desired structure.

To receive and process a signal to activate an energetic material, the sensor may include a receiver to receive a disintegration instruction or signal, and a triggering component that is effective to generate an electric current. Illustrative triggering component includes batteries or other electronic components. Once a disintegration instruction or signal is received, the triggering component generates an electric current and triggers the activation of the energetic material. The disintegration signal may be obtained from the surface of a wellbore or from a signal source in the well, for example, from a signal source in the well close to the energetic disintegrable material.

When the polymer in the polymer matrix is exposed to the heat generated by the self-propagation reaction of the energetic material, the polymer chemically decomposes producing a decomposed product containing at a small molecule that may be turned into a supercritical state.

As used herein, a small molecule refers to a compound having less than 16, less than 10, or less than 8 carbon atoms. Examples of the small molecules include at least one of acetylene, ethylene, methane, carbon dioxide, carbon monoxide, formaldehyde, a phenol, a bisphenol, or water. The produced small molecules are subject to an elevated temperature and a super-atmospheric pressure. When the elevated temperature and super-atmospheric pressure exceed a supercritical temperature and a supercritical pressure of the small molecule, the small molecule is turned into a supercritical state. The elevated temperature may be provided by the heat generated by the self-propagation reaction of the energetic material. The super-atmospheric pressure applied to the small molecule may be provided by a downhole environment. Because there is no boundary between liquid and gas for compounds in a supercritical state, decomposing the polymer may result in a minimal pressure increase, which avoids explosion, or choking of the self-propagation reaction of the energetic material, or otherwise uncontrolled disintegration of the downhole articles. In an aspect, chemically decomposing the polymer as described herein may result in a pressure increase of less than about 100 psi or less than about 80 psi under a hydrostatic pressure of 400 to 1500 psi in a downhole environment.

Advantageously, the decomposition of the polymer is not affected or counteracted by the downhole hydrostatic pressure. The downhole article may disintegrate in tens of seconds with direct contact to downhole fluid under hydrostatic pressures once the energetic material is activated. The disintegration of the downhole article is safe to the adjacent tools including seal elements as the decomposition of the polymer results in minimal pressure and temperature increase. In addition, there is no explosion or flames during the disintegration of the downhole article, and the disintegration does not create projectiles or shock waves which may have undesirable consequences.

The energetic disintegrable material and method of use are further illustrated in the example.

EXAMPLE

A test coupon was made of a composite of an epoxy matrix, an energetic material, and a fiber with a weight ratio of 22:66:5. The epoxy resin comprised 60-80 wt % bisphenol A diglycidyl ether (CAS #1675-54-3) and the balance being phenol-formaldehyde polymer glycidyl ether (CAS #28064-14-4) and 1,4-butane diglycidyl ether (CAS #2425-78-8).

The composite had a tensile strength of about 45 ksi, determined in accordance with ASTM D3039; and a compressive strength of about 18 ksi, determined in accordance with ASTM D6641. The composite also had a ductility of about 2%.

Figure 5A:
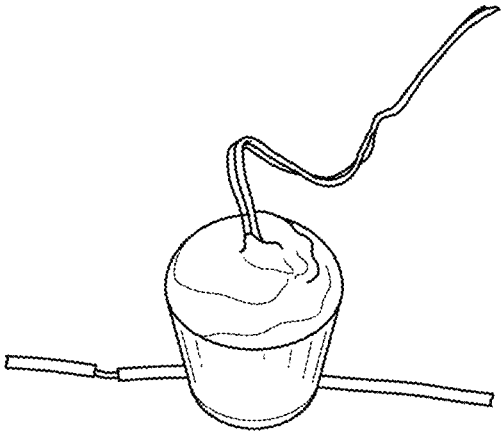
FIG. 5A shows a coupon made from a polymer having an oxygen content of 2-30 wt %, an energetic material, and a reinforcing fiber.
Figure 5B:
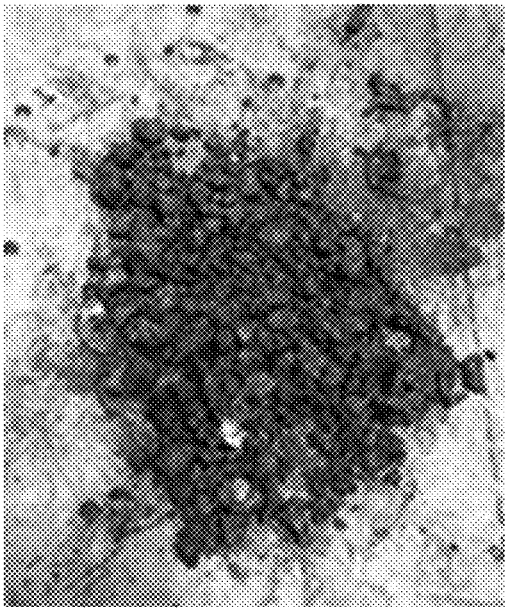
FIG. 5B shows the disintegrated coupon of FIG. 3A.
Figure 6:
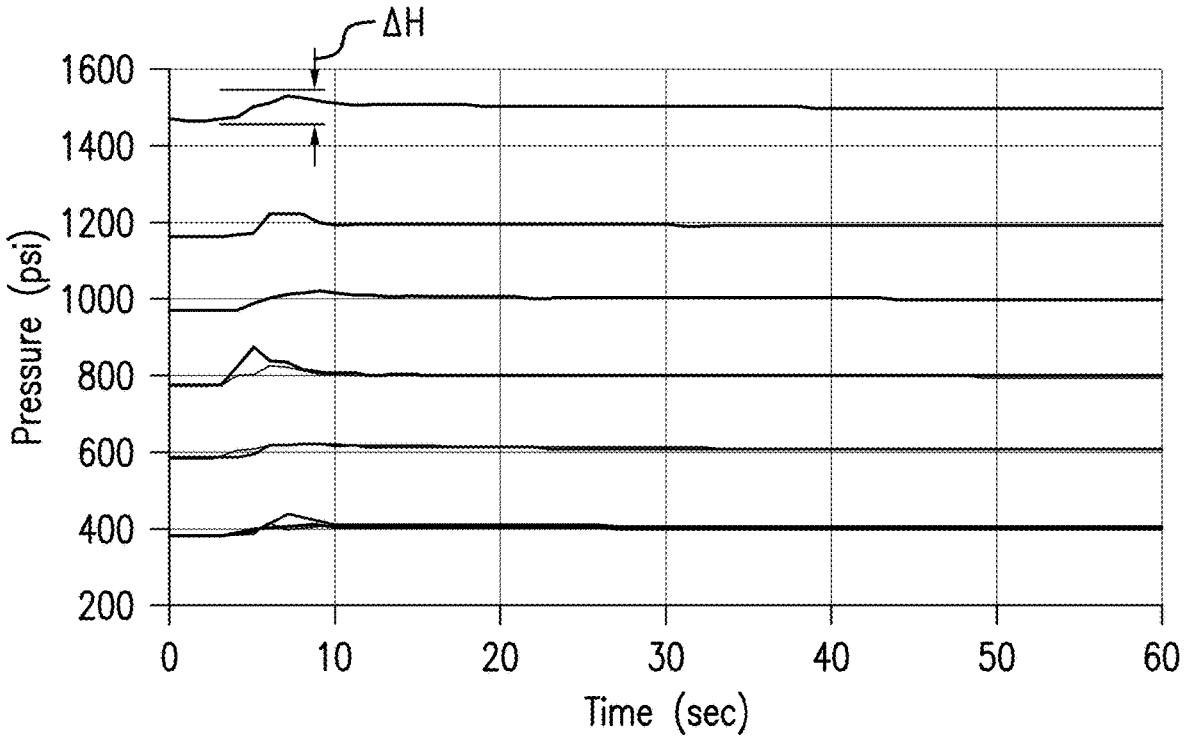
FIG. 6 is a graph of pressure (pound per square inch, psi) versus time (second, sec) illustrating the pressure in an autoclave as a function of time after the energetic material in the coupon of FIG. 5A is activated in the autoclave.

FIG. 5A is a coupon with a watertight trigger sealed and embedded inside the coupon. A ceramic crucible wrapped and covered with steel mesh was placed outside the coupon to restrict the coupon remaining submerged during the test. Then the coupon was submerged under a test fluid in an autoclave (high pressure vessel). And then the autoclave was closed and pressurized with compressed gas to test the hydrostatic pressure effect under downhole conditions. The trigger was then activated, and after the test, the coupon was completely disintegrated into small pieces as shown in FIG. 5B. The decomposed pieces do not have the strength of the coupon and may be readily pulverized. FIG. 6 shows that a pressure increase ($\Delta H$) resulted from the decomposition of the polymer is about 50 psi under high hydrostatic pressures from 400 to 1500 psi. A peak temperature rise of about 55° F. was recorded near the test coupon.

Figure 7:
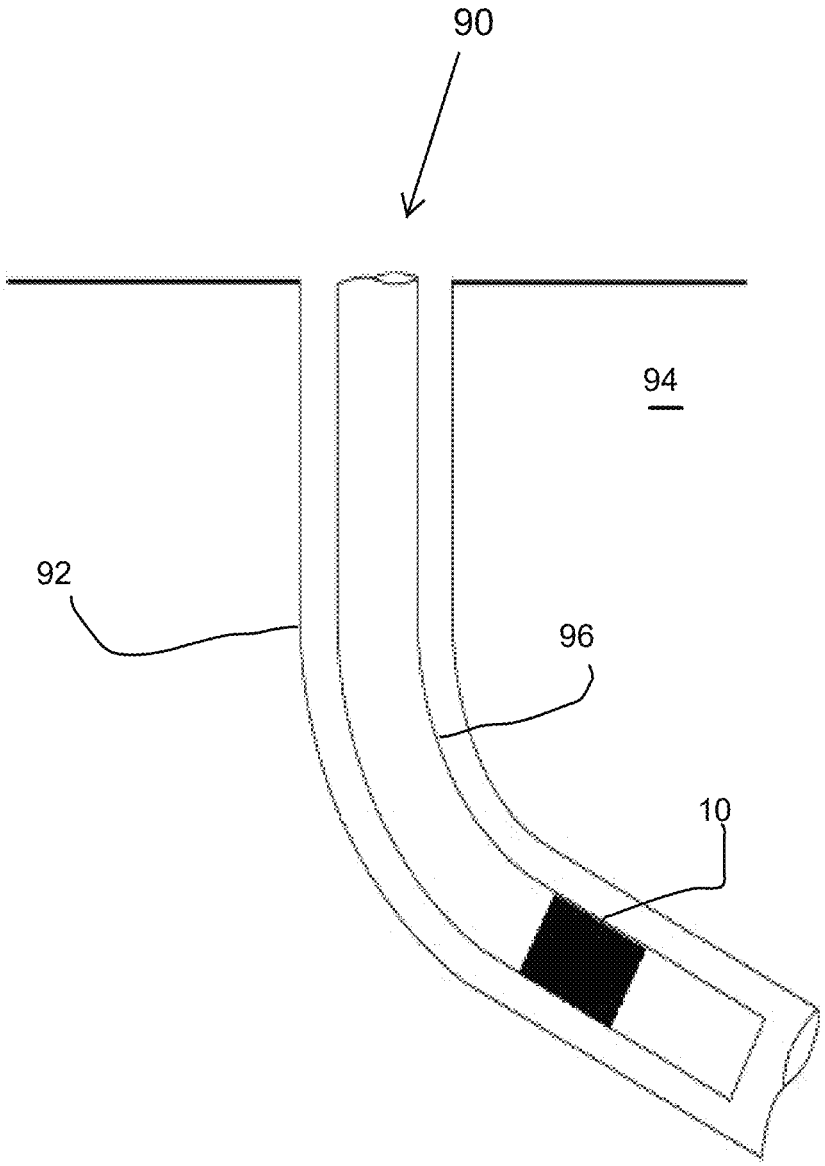
FIG. 7 is a view of a borehole system including a liner hanger with anti-preset feature as disclosed herein.

Referring to FIG. 7, a borehole system 90 is illustrated. The system 90 comprises a borehole 92 in a subsurface formation 94. A string 96 is disposed within the borehole 92. A tool 10 disposed within or as a part of the string 96 as disclosed herein.

Set forth below are some embodiments of the foregoing disclosure:

Embodiment 1: A tool with anti-preset feature including a tool body including a setter, an anti-preset member anchoring the setter to the tool, and a releaser that loses structural integrity through heat or chemical degradation upon receipt of a signal configured to defeat the anti-preset member.

Embodiment 2: The tool as in any prior embodiment, wherein the body includes a slip and the setter is a slip setter.

Embodiment 3: The tool as in any prior embodiment, wherein the releaser comprises a signal responsive material.

Embodiment 4: The tool as in any prior embodiment, wherein the signal responsive material is a Degrade on Demand material.

Embodiment 5: The tool as in any prior embodiment, wherein the signal responsive material is responsive to an electrical signal.

Embodiment 6: The tool as in any prior embodiment, wherein the signal responsive material is ignitable by a signal propagator.

Embodiment 7: The tool as in any prior embodiment, wherein the signal propagator is another volume of Degrade on Demand material disposed in ignition proximity to the releaser.

Embodiment 8: The tool as in any prior embodiment, wherein the releaser is configured to release a radially outward portion of the anti-preset member from a radially inward portion of the anti-preset member.

Embodiment 9: The tool as in any prior embodiment, wherein the releaser is the entirety of the anti-preset member.

Embodiment 10: The tool as in any prior embodiment, wherein the anti-preset member includes a geometric mechanical engagement at a radially outer surface of the anti-preset member that engages a complementary geometric engagement of the slip setter.

Embodiment 11: The tool as in any prior embodiment, wherein the anti-preset member incudes a geometric mechanical engagement at a radially inner surface of the anti-preset member that engages a complementary geometric engagement of the liner hanger body.

Embodiment 12: A liner hanger setting system, including a running tool, including an actuator package, a first pressure sensor uphole of a plug location connected to the actuation package, a second pressure sensor downhole of the plug location connected to the actuator package, the package programmed to perceive a differential pressure between the first and second pressure sensors, a signal propagator operably connected to the actuator package, a liner hanger body including a slip and a slip setter initially supported by the running tool, an anti-present member anchoring the slip setter to the liner hanger, and a releaser that loses structural integrity through heat or chemical degradation upon receipt of a signal configured to defeat the anti-preset member, the releaser in operable communication with the signal propagator.

Embodiment 13: A method for setting a liner hanger, including running the liner hanger setting system as in any prior embodiment to a target location in a borehole, sending a signal to the releaser, defeating the releaser, and facilitating relative movement between the liner hanger body and the setter.

Embodiment 14: The method as in any prior embodiment, wherein the sending includes sensing pressure upstream of a plug disposed within the running tool and sensing pressure downstream of the plug to determine a differential pressure and generating a signal with the actuator package.

Embodiment 15: The method as in any prior embodiment, wherein the sending includes igniting the signal propagator.

Embodiment 16: The method as in any prior embodiment, wherein the igniting causes ignition of the releaser.

Embodiment 17: A borehole system, including a borehole in a subsurface formation, a string in the borehole, and a tool as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool with an anti-preset feature comprising:

a tool body including a liner hanger body, and a setter configured to move relative to the liner hanger body;

a space defined radially outwardly by the liner hanger body;

an anti-preset member anchoring the setter to the liner hanger body, the member having a portion thereof disposed on an outside surface of the liner hanger body and a portion thereof extending through the liner hanger body to the space;

a releaser disposed in or making up an entirety of the anti-present member;

a signal propagator disposed in the space in very near thermal but not physical contact with the releaser, the releaser configured to lose structural integrity through heat or chemical degradation upon receipt of a signal from the signal propagator to defeat the anti-preset member.

2. The tool as claimed in claim 1, wherein the body includes a slip and the setter is a slip setter.

3. The tool as claimed in claim 1, wherein the signal responsive material is an energetic material.

4. The tool as claimed in claim 1 wherein the signal responsive material is responsive to an electrical signal.

5. The tool as claimed in claim 1, wherein the signal responsive material is ignitable by the signal propagator.

6. The tool as claimed in claim 5, wherein the signal propagator is another volume of Degrade on Demand material disposed in ignition proximity to the releaser.

7. The tool as claimed in claim 1, wherein the releaser is configured to release a radially outward portion of the anti-preset member from a radially inward portion of the anti-preset member.

8. The tool as claimed in claim 1, wherein the anti-preset member includes a geometric mechanical engagement at a radially outer surface of the anti-preset member that engages a complementary geometric engagement of the setter.

9. The tool as claimed in claim 1, wherein the anti-preset member incudes a geometric mechanical engagement at a radially inner surface of the anti-preset member that engages a complementary geometric engagement of the liner hanger body.

10. A liner hanger setting system, comprising:

a running tool, including:

an actuator package;

a first pressure sensor uphole of a plug location connected to the actuation package;

a second pressure sensor downhole of the plug location connected to the actuator package, the package programmed to perceive a differential pressure between the first and second pressure sensors;

a signal propagator operably connected to the actuator package;

a liner hanger body including a slip and a slip setter initially supported by the running tool;

an anti-preset member anchoring the slip setter to the liner hanger, the anti-preset member having a portion thereof disposed on an outside surface of the liner hanger body and a portion thereof extending through the liner hanger body to space radially inwardly of the liner banger body; and a releaser disposed in or making up an entirety of the anti-present member in very near thermal but not physical contact with the signal propagator, the releaser configured to lose structural integrity through heat or chemical degradation upon receipt of a signal from the signal propagator.

11. A method for setting a liner hanger, comprising:

running the liner hanger setting system as claimed in claim 10 to a target location in a borehole;

sending a signal to the releaser;

defeating the releaser; and facilitating relative movement between the liner hanger body and the setter.

12. The method as claimed in claim 11, wherein the sending includes sensing pressure upstream of a plug disposed within the running tool and sensing pressure downstream of the plug to determine a differential pressure and generating a signal with the actuator package.

13. The method as claimed in claim 11, wherein the sending includes igniting the signal propagator.

14. The method as claimed in claim 13, wherein the igniting causes ignition of the releaser.

15. A borehole system, comprising:

a borehole in a subsurface formation;

a string in the borehole; and a tool as claimed in claim 1 disposed within or as a part of the string.

* * * * *